US005542873A

United States Patent [19]

Shank, Jr.

[11] Patent Number: 5,542,873

[45] Date of Patent: Aug. 6, 1996

[54] NOVEL MEDIA VALVE

[75] Inventor: James D. Shank, Jr., Vestal, N.Y.

[73] Assignee: Church & Dwight Co., Inc., Princeton, N.J.

[21] Appl. No.: 385,173

[22] Filed: Feb. 7, 1995

Related U.S. Application Data

[63] Continuation-in-part of Ser. No. 161,530, Dec. 6, 1993, Pat. No. 5,421,767, which is a continuation-in-part of Ser. No. 229,011, Apr. 18, 1994, Pat. No. 5,401,205.

[51] Int. Cl.[6] ..... B24C 3/00

[52] U.S. Cl. ..... 451/75; 451/101; 451/102

[58] Field of Search ..... 451/99.91, 75, 451/95, 101, 102; 137/385; 251/121, 63, 63.5, 297

[56] References Cited

U.S. PATENT DOCUMENTS

| | | | |
|---|---|---|---|
| 3,476,440 | 11/1969 | Schmidt et al. | 302/53 |
| 3,608,576 | 9/1971 | Wilhelm | 137/242 |
| 4,534,139 | 8/1985 | Desjardins | 451/101 |
| 4,877,218 | 10/1989 | Kasner | 251/61.3 |
| 4,893,738 | 1/1990 | Gelians | 222/380 |
| 4,909,277 | 3/1990 | Vandiver | 137/493.7 |

*Primary Examiner*—Bruce M. Kisliuk

*Assistant Examiner*—Derris Banks

*Attorney, Agent, or Firm*—Irving M. Fishman

[57] ABSTRACT

A media control valve used to meter and dispense an amount of abrasive media from a supply pot to a compressed airline for blast cleaning comprises; a media passage communicating with the supply pot and an airflow tube, a bore disposed in the valve and communicating with the media passage, a media control sleeve placed within the bore disposed between the media passage and the airflow tube and containing a plurality of spaced restricting orifices, a valve stem slidable within the media control sleeve and capable of opening and closing the orifices, the valve stem being secured to an activating means to move the valve stem in a manner such that the valve stem will self-align itself within the interior of the media control sleeve. The self-alignment feature is provided by dividing the valve stem into a lower valve stem portion and an upper valve stem portion which is secured to the activating means. The lower valve stem portion and upper valve stem portion are linked together by a self-aligning linkage which comprises an oversized bore in the upper valve stem portion which receives the upper end of the lower valve stem portion thus allowing the lower valve stem to move laterally in the space provided by the oversized bore. A novel indexing means for aligning a desired orifice on the media control sleeve in communication with the media passage is also provided.

21 Claims, 3 Drawing Sheets

Fig. 2
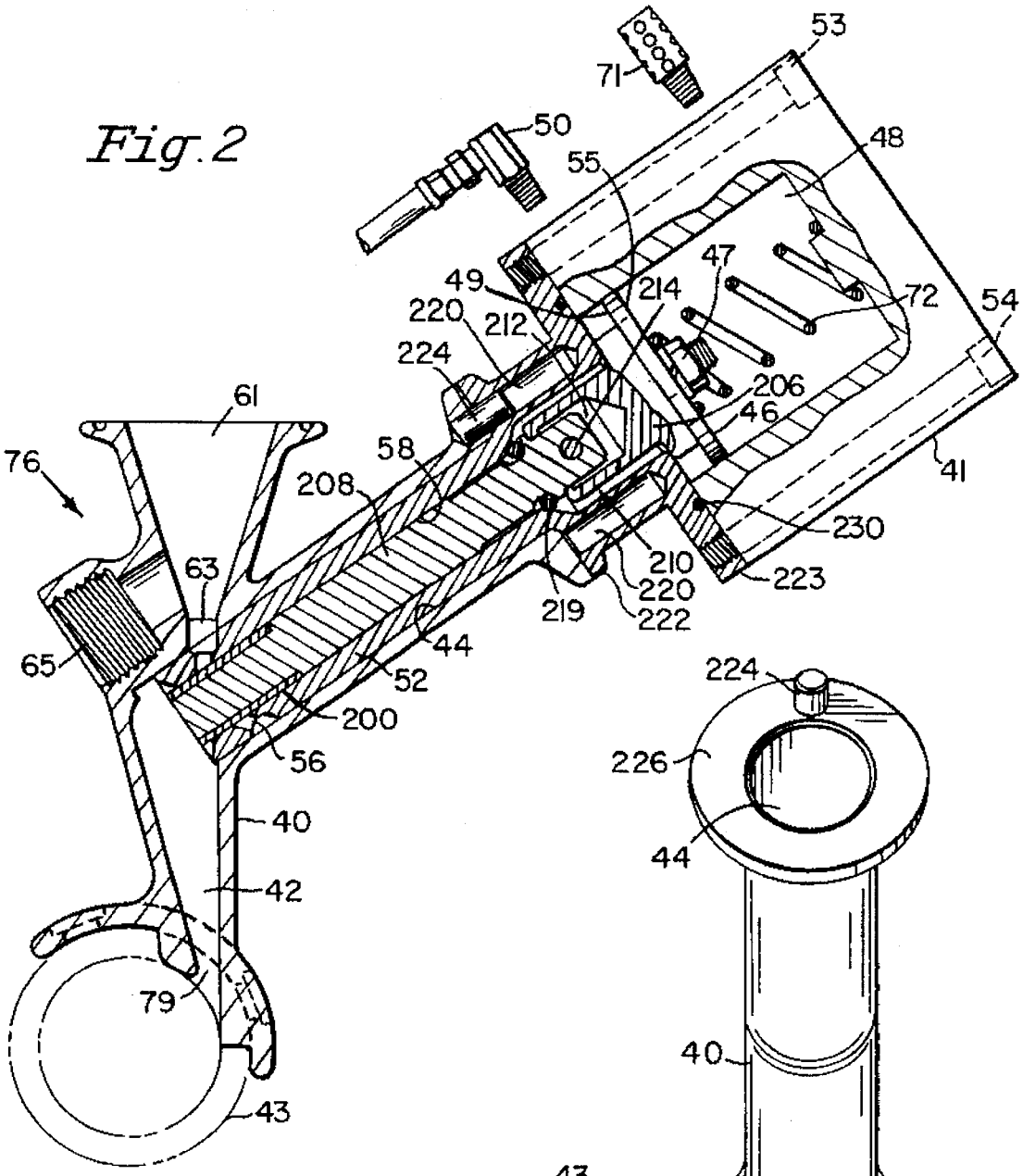
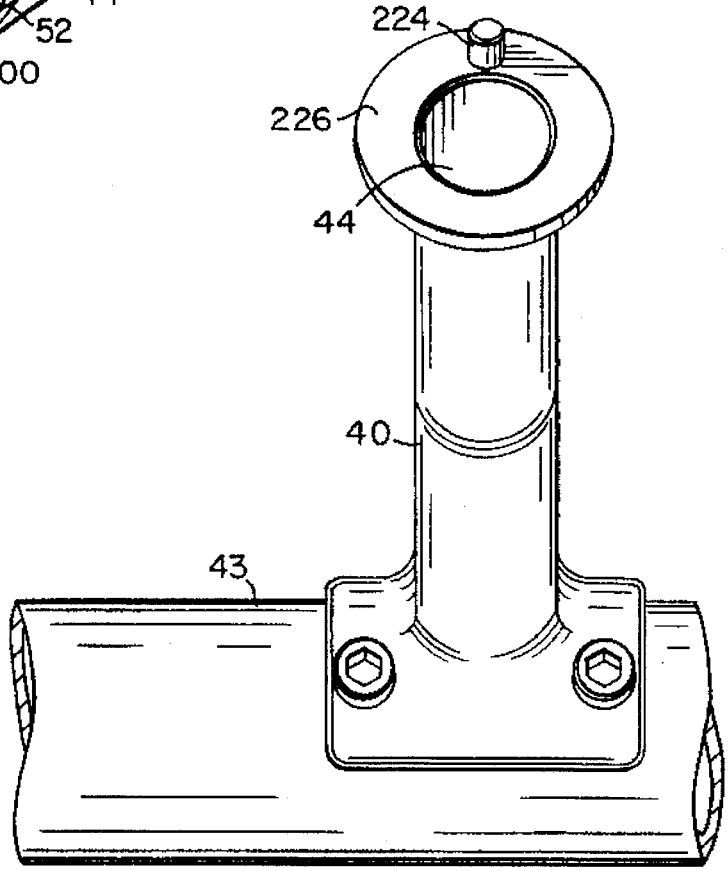
Fig. 3

NOVEL MEDIA VALVE

This is a continuation-in-part application of U.S. patent application Ser. No. 08/161,530, filed Dec. 6, 1993 and a continuation-in-part application of U.S. patent application Ser. No. 08/229,011, filed Apr. 18, 1994, which are U.S. Pat. No. 5,421,767 and 5,401,205 accordingly.

BACKGROUND OF THE INVENTION

Standard sand blasting equipment consists of a pressure vessel or supply pot to hold particles of a blasting medium such as sand, a source of compressed air connected to the supply pot via a conveying hose and a means of metering the blasting medium from the supply pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the size of the equipment. Commercially available sand blasting apparatus typically employ media flow rates of 10–20 pounds per minute. About 0.5 to 1 pound of sand are used typically with about 1.0 pound of air, thus yielding a ratio of 0.5 to 1.0.

When it is required to remove coatings such as paint or to clean relatively soft surfaces such as aluminum, magnesium, plastic composites and the like, or to avoid surface alteration of even hard materials such as stainless steel, less aggressive abrasives, including inorganic salts such as sodium chloride and sodium bicarbonate, can be used in place of sand in conventional sand blasting equipment. The media flow rate used for the less aggressive abrasives is substantially less than that used for sand, and has been determined to be from about 0.5 to about 10.0 pounds per minute, using similar equipment. The lower flow rates require a much lower media to air ratio, in the range of about 0.05 to 0.5.

However, difficulties are encountered in maintaining continuous flow at these low flow rates when conventional sand blasting equipment is employed. The fine particles of an abrasive media such as sodium bicarbonate are difficult to convey by pneumatic systems by their very nature. Further, the bicarbonate media particles tend to agglomerate upon exposure to a moisture-containing atmosphere, as is typical of the compressed air used in sand blasting. Flow aids such as hydrophobic silica have been added to the bicarbonate in an effort to improve the flow, but maintaining a substantially uniform flow of bicarbonate material to the blast nozzle has been difficult to achieve. Non-uniform flow of the blast media leads to erratic performance, which in turn results in increased cleaning time and even to damage of somewhat delicate surfaces.

Commonly assigned U.S. Pat. Nos. 5,081,799 and 5,083,402 disclose a modification of conventional blasting apparatus by providing a separate source of line air to the supply pot through a pressure regulator to provide a greater pressure in the supply pot than is provided to the conveying hose. This differential pressure is maintained by an orifice having a predetermined area and situated between the supply pot and the conveying hose. The orifice provides an exit for the blast media and a relatively small quantity of air from the supply pot to the conveying hose, and ultimately to the nozzle and finally the workpiece. The differential air pressure, typically operating between 1.0 and 5.0 psi with an orifice having an appropriate area, yields acceptable media flow rates in a controlled manner. The entire contents of U.S. Pat. Nos. 5,081,799 and 5,083,402 are herein incorporated by reference.

A media metering and dispensing valve which meters and dispenses the abrasive from the supply pot through the orifice and to the conveying hose carrying the compressed air stream typically operates automatically whenever the compressed air is applied to the blast hose to begin the abrasive blasting operation. The media valve for use in the afore-mentioned metering and dispensing process as disclosed in U.S. Pat. Nos. 5,081,799 and 5,083,402 is characterized as a Thompson valve and is described generally in U.S. Pat. No. 3,476,440, the contents of which are herein incorporated by reference. The Thompson valve includes a metering valve stem which blocks the outlet of a discharge tube disposed between the supply pot and an air flow tube which is secured to and carries the compressed air to the conveying hose. When the blast nozzle is activated, the valve stem is lifted from the valve seat of the Thompson valve and allows a controlled amount of media to flow through the outlet of the discharge tube into the air flow tube. The valve as disclosed in U.S. Pat. No. 3,476,440 has been improved by placing a plurality of orifices having different sizes within a control sleeve which is placed around the end of the valve stem. One of the orifices can be placed in communication with the outlet of the discharge tube and the air flow tube. When the valve stem is placed fully within the control sleeve, the orifice in the control sleeve is blocked such that media cannot flow from the discharge tube through the orifice in the media control sleeve and then into the air flow tube. Upon operation of the blast nozzle, the valve stem is lifted within the control sleeve and pulled away from the orifice to allow the media flow from the pot to the discharge tube, through the orifice and into the air flow tube.

The plurality of orifices provides another means of controlling the amount of media flowing from the supply pot into the compressed air stream and into the blast nozzle apparatus. Unfortunately, to change the orifice which is in alignment with the media discharge tube and the air flow tube or to clean out a plugged orifice in the Thompson valves now on the commercial market, it is required that the valve body holding the sleeve be taken apart, the control sleeve taken out, rotated, placed back in its slot and the valve body then restructured. Obviously such disassembly and reassembly is cumbersome and certainly does not allow for efficient blast cleaning on the job site.

The present assignee has developed a novel and improved media control valve which is particularly useful in the differential pressure metering system of U.S. Pat. Nos. 5,081,799 and 5,083,402. The improved metering valve offers additional control with respect to metering the flow of media. Like the prior art Thompson media control valves, the novel valve includes a control sleeve which contains a plurality of orifices, one of which can be aligned to communicate with the discharge of the media from the supply pot and the air flow tube to dispense the media into the compressed air stream. The plurality of orifices have a different diameter to allow enhanced control of the amount of media dispensed from the supply pot to the compressed air flow tube by allowing a change of orifice size. Importantly, however, the control sleeve is made longer to encompass the valve stem and is attached to the valve body. To control the metering of the abrasive media into the air flow tube, the control sleeve can be rotated from the exterior of the valve body while still in place in the valve body to align a different orifice with the media discharge passage in communication with the supply pot and the compressed air flow tube. Alternative embodiments are provided to index the control sleeve such that an orifice is properly aligned upon rotation of the control sleeve. In one embodiment, the index means comprises a ball spring plunger placed in the valve body and exerted against the control sleeve and a series of detents spaced in the sleeve and aligned with each orifice so as to properly align the orifice with the media discharge passage from the supply pot and the air flow tube when the ball spring plunger fits within a detent in the sleeve. The control sleeve and the enclosed valve stem can be easily removed from the valve body in one piece for cleaning and replaced and locked in place in the valve body by means of a lock pin without disassembling the body of the valve. In the second embodiment, the index means comprises a plurality of grooves which are placed on the face of the bore which receives the control sleeve and which mate with a plurality of teeth on the control sleeve. The teeth are aligned with the orifices. To change orifices, the control sleeve is lifted to disengage the teeth from the grooves and rotated until the teeth and grooves are again aligned and the sleeve then dropped in place in the valve body. The media control valve also includes a manually adjustable multi-port valve placed within the media discharge passage and which can close off the discharge passage from the supply pot, and allow compressed air to back clean the valve and direct debris out a clean-out port in the valve body. The novel and improved media control valve is described in commonly assigned, copending application, U.S. patent application Ser. No. 161,530, filed Dec. 6, 1993, the entire contents of which are herein incorporated by reference.

Below the orifice in the improved media control valve disclosed in U.S. patent application Ser. No. 161,530, is a media discharge tube which directs and feeds the abrasive media from the orifice into the air flow tube. In accordance with an improvement in such valve as disclosed in copending, commonly assigned U.S. patent application Ser. No. 229,011 filed Apr. 18, 1994, the media discharge tube converges downstream of the orifice to the outlet thereof in the air flow tube such that outlet is shaped as a slot-like outlet of elliptical to rectangular shape. The length of the outlet slot into the air flow tube runs in the same direction as the compressed air passing through the air flow tube. Accordingly, the perimeter of the outlet placed perpendicular to the direction of compressed air passing through the air flow tube is minimized which consequently greatly reduces the air turbulence in the air flow tube at the outlet of the media discharge tube. Reduced turbulence at the media outlet into the air flow tube reduces variations in the air line pressure in the media discharge tube immediately below the orifice providing for accurate and consistent differential pressure across the orifice and consequent uniform metering of the abrasive media into the compressed air stream.

Importantly, the media outlet of the media control valve disclosed in U.S. patent application Ser. No. 229,011 unlike previous media control valves which dispensed the abrasive media into the center regions of the air flow tube wherein the compressed air speed was the fastest and the air, the most turbulent, dispenses the abrasive media tangential to the circumferential inner surface of the air flow tube where the air is most likely in laminar flow due to boundary effects along the inner tube wall. Injection of the media into the low speed air along the inner wall of the air flow tube minimizes turbulence of the abrasive media so as to maintain the integrity of the individual abrasive particles and additionally reduces valve wear at the outlet to the air flow tube.

While the improved media valves of above-mentioned U.S. patent application Ser. Nos. 161,530 and 229,011 are convenient to use and can very accurately dispense an abrasive media such as sodium bicarbonate into an air stream, there has occurred several problems when using the valves over extended periods of time. It has been found that abrasive particles and dust can accumulate between the media control sleeve and the valve stem which slides therein to open and close the orifices at the end of the media control sleeve. Accordingly, over time, this abrasive has been found to cause wear on the valve stem which results in the leakage of more abrasive particles into the space between the media control sleeve and the valve stem and further has prevented the operation of the valve stem as too much wear and too much accumulated abrasive dust often can hinder movement of the valve stem.

Upon the addition of the control sleeve, the valve seat was eliminated. Accordingly, very tight tolerance between the valve stem and the interior of the control sleeve has been necessary to prevent unwanted media flow. Abrasive wear on the valve stem disrupts the tight clearance between these valve components. Moreover, if the media control sleeve is not accurately machined and aligned with the bore which receives the valve stem in the pneumatic chamber which activates the valve stem, this again can result in substantial wear on the valve stem as it moves through the media control sleeve. Even a minor misalignment can disrupt the tight clearance and prevent the smooth operation and movement of the valve stem through the control sleeve resulting in excessive wear, leakage of abrasive dust in the bore of the media control sleeve and actual stoppage of the valve stem from passing totally through the media control sleeve.

SUMMARY OF THE INVENTION

It is a primary objective of the present invention to improve the media control valves disclosed in afore-mentioned copending, commonly assigned U.S. patent application Ser. Nos. 161,530 and 229,011 by reducing the wear of the valve stem as it passes through the media control sleeve.

It is another objective of the present invention to improve the afore-mentioned media control valves by reducing the wear of the valve stem as it passes through the media control sleeve even though the bore through the media control sleeve is not properly aligned with the valve stem as it is supported in the activating pneumatic chamber.

Still another object of the present invention is to improve the above-mentioned media control valves by increasing the hardness of the valve stem so as to reduce the wear thereon.

Still yet another objective of the present invention is to provide a novel indexing means which can properly align a desired orifice with the media discharge passage from the supply pot and the air flow tube.

These and other objects of the present invention are achieved by adhering a hard metallic, e.g. tungsten carbide, sleeve onto the end of the valve and stem on that portion of the valve stem which comes in contact with the abrasive media.

Importantly, reduced wear on the valve stem is achieved by separating the valve stem into a lower portion which passes through the media control sleeve to open and close the orifices and an upper portion which is movable in the activating pneumatic chamber, and joining the upper and lower portions by a self-aligning linkage. The linkage comprises an oversized support bore in the upper portion of the valve stem in which is placed the upper end of the lower valve stem portion which is supported in the oversized bore by a pin. The linkage allows the lower portion of the valve stem to move laterally along the pin a small amount within the oversized bore to compensate for any misalignment between the upper valve stem portion movable in the activating pneumatic chamber and the interior of the media control sleeve through which the valve stem moves. Additionally, the upper valve stem portion is rotatable around its longitudinal axis and the lower valve stem is pivotable on the pin, allowing further compensation for misalignment between the lower valve stem portion and the control sleeve. By allowing the lower valve stem portion to compensate within the oversized bore for any misalignment, the valve stem will move neatly through the media control sleeve which results in greatly reduced wear on the valve stem as it passes through the media control sleeve.

The media control valve is also improved in accordance with the present invention by providing a novel indexing means which comprises a plurality of holes placed in a support flange located around the media control sleeve, which holes are aligned with the orifices at the end of the sleeve, and a peg on the face of the bore of the valve body which receives the control sleeve and which can mate with any of the holes. To change the orifice, the control sleeve is lifted to disengage one hole from the peg and rotated until a different hole is aligned with the peg. The sleeve is then dropped in place in the valve body.

BRIEF DESCRIPTION OF THE DRAWINGS

FIG. 2 is a cross section of the novel media control valve of this invention.

FIG. 3 is a fragmentary view of the valve body of this invention showing the placement of the orifice indexing means.

DETAILED DESCRIPTION OF THE INVENTION

The invention can best be described by first referring to the method of controlling the metering of the abrasive media into the compressed air stream using differential pressure as disclosed in U.S. Pat. No. 5,083,402. In order to feed fine particles of a material such as a bicarbonate abrasive having a mean particle size of from 50 to 1000 microns, preferably from about 200 to 300 microns, at a uniform rate, pressures within the supply pot, including the blast hose pressure, must be positive with respect to the nozzle. Pressures are typically in the range of about 20–125 psig.

Since the supply pot and the conveying hose operate at about the same pressure, the flow of blast media in conventional sand blasting equipment is controlled by gravity feed and a metering valve. It has been found, however, that the supply pot was under a small differential pressure with respect to the blast delivery hose pressure, which fluctuated between positive and negative. The result was that the flow rates of the blast media fluctuated also in response to the differential pressure changes. Accordingly, a differential pressure gauge has been installed between the delivery hose and the supply pot to monitor the differential pressure directly. The pressure can be closely controlled by means of a pressure regulator at any hose pressure from 10 to 125 psig or higher, depending on the supply air pressure. The invention disclosed in U.S. Pat. No. 5,083,402 substantially eliminates the source of flow rate variation and also modifies conventional equipment to handle blast media at low flow rates of from about 0.5 to 10 pounds per minute, preferably up to about 5 pounds per minute.

Figure 1:
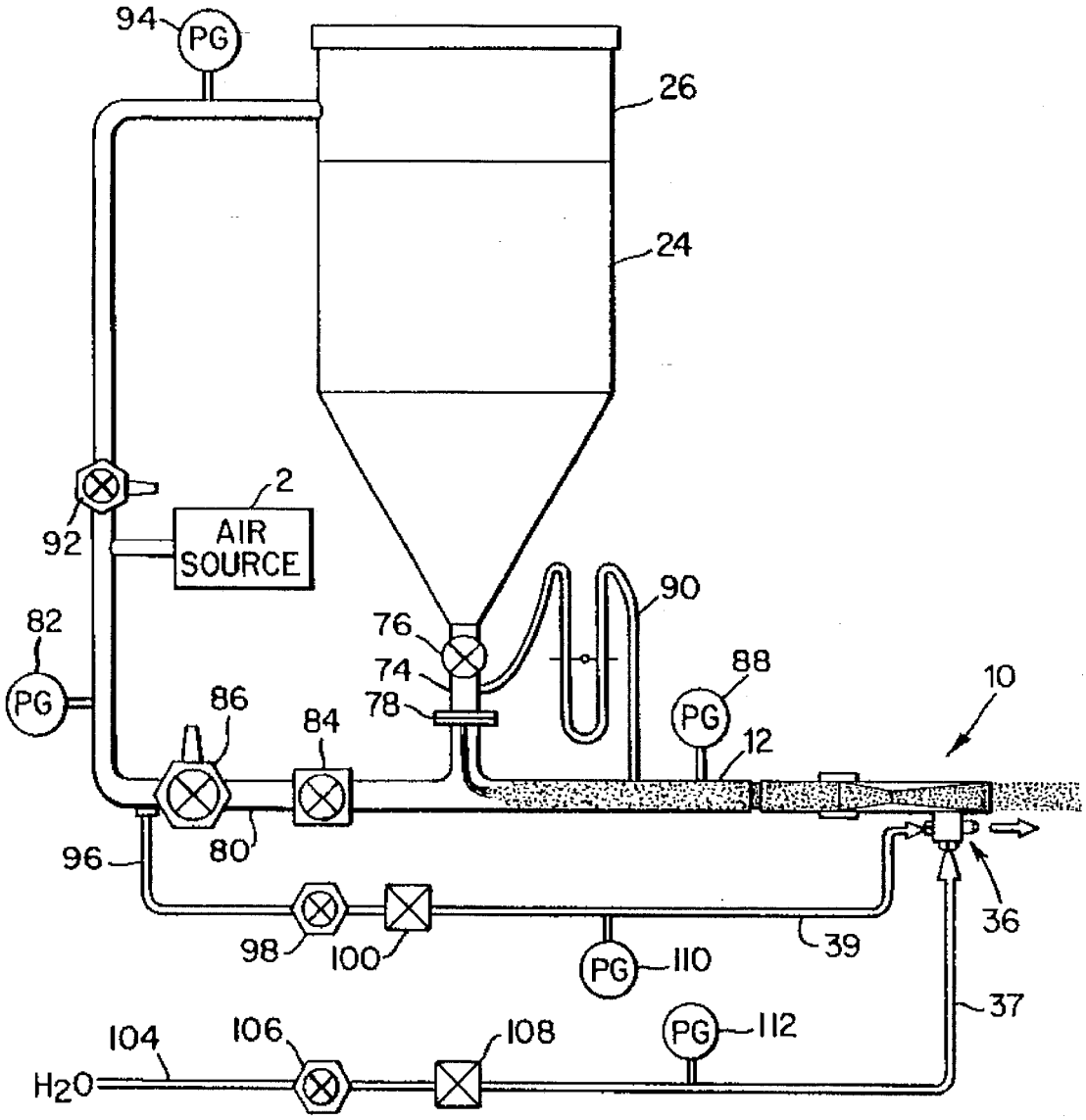
FIG. 1 is a schematic illustration of the differential pressure metering and dispensing system which incorporates the media control valve of the present invention.

The differential pressure metering system can now be described by reference to FIG. 1. Although the blast media illustrated is sodium bicarbonate, sodium sesquicarbonate, trona, other blast media such as potassium bicarbonate, ammonium bicarbonate, sodium chloride, sodium sulfate and other water-soluble salts are meant to be included herein. Referring to FIG. 1, the blast system includes supply pot 26 partially filled with blast media 24. The supply pot 26 suitably having a cavity of about 6 cubic feet, terminates in a media exit line 74 governed by a media control valve 76. The media control area can be further limited by an orifice plate 78 which further restricts the flow of the media 24 to the desired flow rate. A line 80 is connected to a source 2 of pressurized air and is monitored with an inlet monitor 82. Air valve 84 is a remotely operated on/off valve that activates the air flow to blast nozzle 10 and the opening and closing of the media control valve 76. Nozzle pressure regulator valve 86 regulates the nozzle pressure by means of a monitor 88 when the system is in operation. Nozzle pressure regulator valve 86 can maintain the desired nozzle pressure. The nozzle pressure monitor 88 enables a controlled pressure to be applied to the nozzle 10. The differential pressure gauge 90 monitors the pressure between the supply pot 26 and the supply hose 12. The pot pressure regulator 92, measured by gauge 94, is used to provide a pressure higher than the pressure in the conveying hose 12, thus allowing the differential pressure to be monitored by differential pressure gauge 90.

In operation, the blast media 24 is fed through media exit line 74 governed by the media control valve 76 to an orifice plate 78, which further regulates the flow of media to the compressed air line 80. The orifice openings can vary from about 1/16 to about 1/4 inch diameter, or openings corresponding to the area provided by circular orifices of 1/16 to 1/4 inch diameter. Preferably, the openings correspond to about a 0.125 inch opening for sodium bicarbonate media having a mean particle size of about 70 microns, and 0.156 inch opening for a media having a mean particle size from about 250 to about 300 microns. A positive pressure of between about 1 to 5 psig preferably about 2 to 4 psig between the media exit line 74 and the conveying hose 12 is maintained at all times. A source 2 of compressed air is fed to the air line 80, regulated by the valves 84 and 86 to the desired air pressure and nozzle pressure, respectively, which preferably is between about 30 to about 150 psi, and more preferably between about 40 and 85 psi. The pot pressure regulator 92 controls the pressure to the top of the supply pot 26, further ensuring a controlled and uniform flow of blast media 24. The manometer or other differential pressure gauge 90 measures the differential pressure, which is proportional to the amount of media flowing through the orifice 78. The blast media and compressed air are delivered to the nozzle 10 and ejected toward the workpiece at a uniform and controllable rate.

Optional equipment for protection of and cooling of the workpiece and, in particular, for the control of dust is provided by a water atomizer 36 which directs a spray of atomized water toward the work surface. A more detailed description of the water atomizer is disclosed in commonly assigned U.S. Pat. No. 5,319,894 issued Jun. 14, 1994, the contents of which are herein incorporated by reference. The operation of the water atomizer nozzle 36 is similar to that described for the blast nozzle 10 above. Thus, air typically from the same supply which feeds blast nozzle 10 is directed through line 96 and the pressure thereof controlled by pressure regulator valve 98. Hose 39 directs the pressurized air to the appropriate air inlet port in the nozzle body of the water atomizer 36. Valve 100 is a on/off valve which is controlled by the operator. Water for the water atomizer nozzle 36 is directed from a supply (not shown) and passed through line 104. The pressure is controlled by pressure regulator valve 106. Water through hose 37 is passed to a water inlet port of the nozzle body of water atomizer 36. Pressure gauges 110 and 112 indicate to the users the pressures in lines 96 and 104, respectively. All of the on/off valves 84, 100 and 108 are controlled by the operator through a deadman switch (not shown) and, thus, all flow of air, abrasive media and water to blast nozzle 10 and the water atomizer 36 can be activated and cut off by the spring activated switch which is typically in the form of a hand-held trigger adjacent the blast nozzle.

The novel and improved valve of this invention includes orifice 78 and is illustrated in FIG. 2. Improved valve 76 is preferably cast as a valve body 40. A substantially vertical connector (not shown) can be connected with valve body 40 to communicate with the media outlet thereabove within the supply pot 26. The connector extends down and joins with inlet cone 61. Vertical media passage 63 within valve body 40 communicates with inlet cone 61 downstream thereof and further communicates with downstream vertical discharge tube 42 within valve body 40. Discharge tube 42 communicates with downstream horizontal air flow tube 43 which may be formed as part of valve body 40 or attached thereto by welding and the like. The air flow tube 43 is disposed substantially perpendicular to the vertical discharge tube 42 and is in communication with media passage 63, except for when a valve stem 45 is positioned to close the valve and prevent media flow therethrough. Valve stem 45 is placed within a bore 44 contained in valve body 40. Bore 44 is preferably disposed at an acute angle from vertical or is inclined with respect to the vertical discharge tube 42. The amount of angle is not critical and can be from about 20° to 90° from vertical. Valve stem 45 is movable within bore 44 to close and seal off discharge tube 42 from media passage 63 and prevent any of the abrasive or air pressure within the pot 26 and media passage 63 from entering the air flow tube 43.

A piston 46 is connected to, or is formed integrally with valve stem 45. Piston 46 can be threaded onto valve stem 45 and secured in place by lock nut 47. Piston 46 is placed in sealing engagement with the inside surface of pneumatic chamber 48 contained in cylinder 41 which is separate from valve body 40. The lower surface 49 of piston 46 is in communication by means of a connecting pressure supply tube 50 with air pressure supplied from the same air pressure source which feeds air to air flow tube 43. Accordingly, compressed air applied to air flow tube 43 is also applied to the lower surface 49 of piston 46 to move piston 46 and attached valve stem 45 upward and out of communication with media passage 63. Valve stem 45 can be returned to the closed position when the air pressure on the lower surface 49 of piston 46 is reduced and bled through member 71 and biased to close by means of a spring 72. Alternatively and/or in combination with spring 72, compressed air can be provided via a supply tube (not shown) to the top surface 55 of piston 46 in chamber 48.

Valve stem 45 does not act to meter the amount of abrasive media flowing from media passage 63, through discharge tube 42 and into air flow tube 43. Instead, valve stem 45 is an on-off valve which when retracted will allow free passage of the media from media passage 63, through discharge tube 42 and into air flow tube 43 and when closed will stop all passage of the media between media passage 63 and discharge tube 42. Valve stem 45 is slidable through the interior 58 of a media control sleeve 52 which is placed within bore 44. Media control sleeve 52 is secured to cylinder 41 by a pair of screws 53 and 54. Media control sleeve 52 contains a plurality of spaced orifices 56 of varying diameter and which can be placed into communication with media passage 63 to allow passage of the media through the orifice, into discharge tube 42 and air flow tube 43 when valve stem 45 is in the open position and displaced from media passage 63. Orifices 56 are the equivalent of orifice 78 as shown in the differential pressure media metering and dispensing system as shown in FIG. 1.

Figure 4:
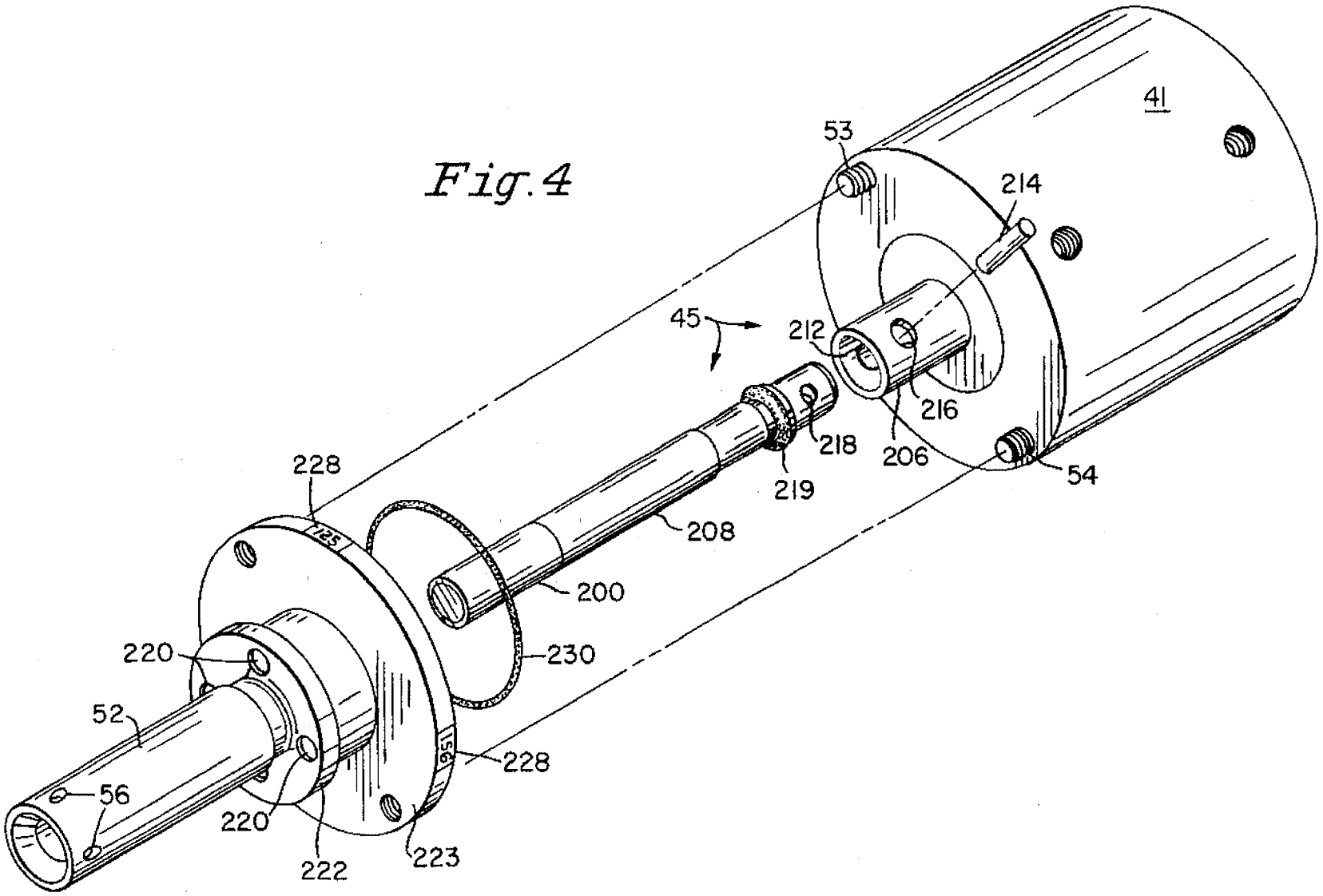
FIG. 4 is an exploded view of the media control sleeve and activating chamber showing the novel self-aligning valve stem and placement of the orifice indexing means on the control sleeve.

Sleeve 52 can be manually rotated such as from the exterior of chamber 41 while in place within bore 44 of valve body 40 so as to place one of the different orifices 56 in communication with media passage 63 and air flow tube 43 via discharge tube 42. In prior art devices, the valve body 40 had to be disassembled, the control sleeve removed entirely from the valve body, and rotated to align the desired orifice with the discharge tube and then returned to the valve body which was then reassembled. In valve 76, control sleeve 52 is manually rotatable without the requirement of tools in place within bore 44 and an index means is provided to align an orifice 56 with media passage 63 and to indicate to the user that the proper alignment has been made. Alternative index means are shown in aforementioned U.S. patent application Ser. No. 161,530. In FIGS. 2–4, a novel index means is illustrated and will be described below.

Another important aspect of the improved valve 76 is that the media control sleeve 52 can be removed from the valve body for cleaning without any disassembling of the valve body 40. Since the media control sleeve 52 is secured to cylinder 41 and valve stem 45 is also secured within pneumatic chamber 48 and fits within the sleeve 52, the whole assembly comprising cylinder 41, chamber 48, media control sleeve 52, valve stem 45 and piston 46 can be slidably removed in one piece from bore 44 of valve body 40. Alternative means to lock and unlock the sleeve assembly within bore 44 can be provided. As shown in FIG. 2, a clamp 66 attached to the exterior of valve body 40 secures sleeve 52 thereto. Again, there is no need to disassemble the valve body or the media control sleeve to remove same from the valve body to allow cleaning of the assembly. Valve 76 also includes a passage 65 to clean out the discharge tube 42 and media passage 63 by application of back pressure.

Referring now to FIG. 2 and as disclosed in aforementioned U.S. patent application Ser. No. 229,011, it can be seen that the discharge tube 42 immediately below orifice 56 (78) converges toward outlet 79. Outlet 79 is shaped as a slot having an elliptical to rectangular shade as opposed to prior art outlets which were circular. The length of the outlet 79 lies in the direction of air flow through air flow tube 43. Accordingly, the perimeter of outlet 79 which is perpendicular to the high speed air flow through air flow tube 43 is greatly minimized relative to circular outlets. Consequently, it is believed that substantially reduced turbulence will result as the high speed air in air flow tube 43 passes across outlet 79. The improvements made to valve stem 45 and the self-aligning connection therewith to cylinder 41, to be described later, however, can be incorporated in media valves in which the outlet to the air flow tube is circular.

Another improved feature of the media control valve which can be included therein is the placement of outlet 79. Thus, outlet 79 is not centered in the air flow tube 43 but is placed on an outer edge thereof so as to dispense the abrasive media flowing from discharge tube 42 tangentially along the inner circumferential surface of air flow tube 43. Along the inner wall of air flow tube 43, the compressed air stream is in substantially laminar flow such that the media can be dispensed uniformly into the air stream without instant formation of areas of non-uniform concentration which is typically the result when the media is dispersed in the center, more high speed, turbulent air. Dispensing an abrasive media such as a light media including sodium bicarbonate in the laminar air reduces the tumbling of the media against the inner wall surface, minimizing degradation of the integrity of the abrasive particles as well as reducing the bouncing of the abrasive particles on the outlet face. It is expected that there would be substantially reduced wear of the valve in the area of outlet 79 by directing the media into the boundary layer air along the inner wall surface of air flow tube 43. As the mixture of abrasive and compressed air flows past the air flow tube and into the remaining portion of the conveying line and conveying hose, the media is slowly mixed with the higher speed air in the center of the conveying line and is uniformly homogenized throughout the entire compressed air stream.

The improvements with respect to the hardness of the outer surface of valve stem 45 and the attachment of valve stem 45 to the activating pneumatic cylinder 48 to provide self-alignment within the interior 58 of media control sleeve 52 can be described by referring to FIGS. 2 and 4. To improve the hardness of the valve stem 45, at least that portion thereof which may come into contact with an abrasive media, such as the lower end of valve stem 45 which passes across orifices 56 in media control sleeve 52, the lower end of valve stem 45 is provided with a hard wear resistant cylindrical sleeve 200. Sleeve 200 can be made of any hard metal or metallic compound such as tungsten carbide or ceramic metal oxide and the like. Sleeve 200 can be attached to the lower end of valve stem 45 such as by an adhesive, welding or any other bonding or fastening technique.

The self-aligning feature of valve stem 45 is provided by dividing valve stem 45 into two components, a first upper valve stem portion 206 which is positioned for movement within activating pneumatic chamber 48 as previously described, and a lower valve stem portion 208 which passes through interior 58 of media control sleeve 52 to open and close off orifices 56. Lower valve stem portion 208 is secured to upper portion 206 by a self-aligning linkage 210. Self-aligning linkage 210 comprises an oversized bore 212 placed in the lower end of upper valve stem portion 206 and which receives the upper end of lower portion 208. Lower valve stem portion 208 is linked to upper portion 206 by means of a dowel pin 214 which is placed through elongated hole or slot 216 in the upper valve stem portion 206 and hole 218 which extends through the upper end of lower valve stem portion 208 (FIG. 4). Accordingly, the dowel pin 214 has room to move laterally in slot 216 and lower valve stem portion 208 can consequently move laterally in oversized bore 212. Additionally, lower valve stem portion 208 can pivot on dowel pin 214 as dowel pin 214 is rotatable in slot 216. This provides further alignment since upper valve stem portion 206 is freely rotatable 360° around its central longitudinal axis. For explanation, if a misalignment exists between lower valve stem portion 208 and the interior 58 of control sleeve 52, upper valve stem portion 206 can rotate within chamber 48 and rotate lower valve stem portion 208 connected thereto. Upon rotation, lower portion 208 can also pivot on dowel pin 214 and self-align within interior 58. Thus, self-aligning linkage 210 is double acting, allowing lateral movement within bore 212 and pivotal movement on pin 214 about 360° of the interior 58. O-rings 219 and 230 can be placed between the lower valve stem portion 208 and the interior surface of media control sleeve 52 and between sleeve 52 and chamber 41, respectively, to prevent abrasives or water from entering the pneumatic cylinder 48.

In operation, if the valve stem 45 and, in particular, lower valve stem portion 208 is not perfectly aligned with the interior 58 of media control sleeve 52 and, thus, comes into hard contact with any interior surface of the media control sleeve, the self-aligning linkage will allow the lower valve stem 208 to adjust and move laterally in slot 216 and oversized bore 212 or provide rotation of the valve stem and pivoting of lower portion 208 on dowel pin 214 to align itself smoothly and properly within interior 58. The self-aligning linkage greatly reduces the wear on the outer surface of the valve stem, and, in particular, the lower regions of lower valve stem portion 208. Previous to this invention, any small misalignment between the valve stem 45 and interior 58 of media control sleeve 52 caused excessive rubbing and wear (galling) of the valve stem 45 against the interior surfaces of the sleeve. If the wear became too great or the misalignment was too great, the valve stem 45 could not properly operate to open and close off the orifices 56. The self-aligning linkage 210 solves this problem and allows extended use of the media control valve without the previous problems of valve stem wear. Further, the self-alignment means allows for reduced energy to move valve stem 45 and, thus, allows for use of a smaller activator 48. Still further, the manufacture of chamber 41, bore 44 of valve body 40 as well as interior 58 of control sleeve 52 does not require such tight specifications due to the self-aligning linkage.

In another aspect of the invention, it is often necessary to change the orifice 56 which is in alignment with the media passage 63 and the media discharge tube 42 for dispensing media into the air flow tube 43. As before mentioned, the assignee has developed media control valves wherein sleeve 52 can be rotated while in place within bore 44 of valve body 40 so as to place one of the different orifices 56 in communication with media passage 63 and discharge tube 42. This has been a substantial improvement over prior art devices in which the valve body 40 had to be disassembled, the control sleeve removed entirely from the valve body, rotated to align the desired orifice with the discharge tube, and then returned to the valve body which was then reassembled. Alternative index means have been described to align the desired orifice 56 with the media passage 63 to indicate to the user that the proper alignment has been made. As shown in FIGS. 2–4, a further alternative indexing means is provided with this invention. In accordance with the present invention, the index means used to properly align the orifices 56 with vertical media passage 63 includes a plurality of spaced holes 220 which are circumferentially spaced through flange 222 of media control sleeve 52. The holes 220 can be mated with a peg 224 which is placed on the face 226 of bore 44 on valve body 40. The orifices 56 are aligned with the holes 220 such that when a hole 220 is mated within peg 224 an orifice 56 is in proper alignment with media passage 63. Indicia 228 relative to orifice size is placed on the outer edge of flange 223 and are aligned with orifices 56 and holes 220 to allow the operator to know which orifice size is in alignment with media passage 63. To change the orifice 56 which is in alignment with media passage 63, the control sleeve 52 which is slidable within bore 44 is lifted enough to disengage peg 224 from hole 220, the control sleeve rotated so that a different hole 220 is in alignment with peg 224 and then the control sleeve 52 dropped into place to mate peg 224 with hole 220 whereupon a different orifice is placed in alignment with media passage 63. It is not necessary that the control sleeve be removed completely from bore 44 nor is there required any disassembly of the valve body 40. Thus, as in the previous indexing means in the aforementioned, copending, commonly assigned application, the media control sleeve does not need to be removed from valve body 40 to change orifice size and, thus, the proper metering of the media through the valve can be controlled by simply manually rotating in place the media control sleeve 52 even while the blasting operation is taking place. As an example, the media control sleeve 52 can contain four orifices having, but not limited to, a size of 0.125, 0.156, 0.187, and 0.209 inch in diameter. The exact size of the orifices is not critical to the invention and the listed sizes are for illustrative purposes only.

In the operation of the media valve 76 in combination with a supply pot 26, pot 26 is filled, or partially filled with, abrasive. After the abrasive is within the pot 26, it is pulled or is otherwise moved to the location for the blast cleaning operation. Supply pot 26 is then connected to a suitable source of compressed air. The compressed air or gas pressurizes the pot 26 and can also be used to supply the air pressure to the air flow tube 43 and air supply tube 50 of valve 76. Thus, pot 26 is pressurized and the valve 76 is automatically opened by displacement of valve stem 45 out of communication with media passage 63 substantially simultaneously. This results in a pressurized flow of the abrasive downwardly through the vertical media passage 63, through one of orifices 56 in control sleeve 52, into discharge tube 42 and dispensed into the pressurized air stream flowing through air flow tube 43. The pressure within air flow tube 43 acts to force the abrasive outwardly to the discharge connection where one or more abrasive blasting hoses with suitable nozzles are connected, as will be well understood.

What is claimed is:

1. In a media control valve for metering and dispensing particulate abrasive media from a supply pot to a compressed air stream which comprises a valve body having a media passage for receiving the abrasive media from the supply pot and for directing the abrasive into an air flow tube below said media passage, said valve body including a bore separate from said media passage and disposed between said supply pot and said air tube and communicating with said media passage an orifice disposed in said media passage, a valve stem slidable within said bore, at least a portion of said valve stem capable of being disposed between said media passage and said orifice to prevent flow of media through said orifice, activating means to move said valve stem within said bore, the improvement comprising: self-alignment means which allows said valve stem to self-align within said bore as said valve stem slidably passes therethrough.

2. The improvement of claim 1 wherein said self-alignment means comprises a lower valve stem portion and an upper valve stem portion, said upper valve stem portion positioned for communication with said activating means, said lower valve stem portion being separate from and connected to said upper valve stem portion by a self-alignment linkage.

3. The improvement of claim 2 wherein said self-alignment linkage comprises an oversized bore in a lower end of said upper valve stem portion which receives an upper end of said lower valve stem portion such that said lower valve stem portion can move laterally within said oversized bore.

4. The improvement of claim 3 wherein the upper end of said lower valve stem portion is secured to said upper valve stem portion by a dowel pin.

5. The improvement of claim 4 wherein said dowel pin passes through a pair of slots in said upper valve stem portion aligned with said oversized bore and through a hole placed in the upper end of said lower valve stem portion.

6. The improvement of claim 4 wherein said lower valve stem portion is pivotable on said dowel pin and said upper valve stem is positioned for rotation about the longitudinal axis thereof.

7. The improvement of claim 1 wherein the portion of said valve stem capable of being disposed between said media passage and said orifice contains a hard metallic sleeve.

8. The improvement of claim 7 wherein said metallic sleeve is separate from said valve stem and is bonded thereon.

9. The improvement of claim 8 wherein said metallic sleeve is tungsten carbide.

10. The improvement of claim 1 wherein said valve further contains a media control sleeve placed in said bore, said orifice being one of a plurality of orifices spaced around said media control sleeve, one of said orifices capable of being aligned with said media passage so as to provide communication between said media passage, said bore and said air flow tube, said valve stem being slidable within said media control sleeve.

11. The improvement of claim 10 wherein said media control sleeve is rotatable within said bore to bring one of said orifices in alignment with said media passage.

12. The improvement of claim 11 further including index means capable of providing proper alignment of one of said orifices with said media passage upon rotation of said media control sleeve within said bore.

13. The improvement of claim 12 wherein said index means comprises a plurality of holes on said media control sleeve which are aligned with each of said spaced orifices, and a peg means on the face of said valve body around said bore such that when one of said holes on said media control sleeve is placed within said peg, one of said spaced orifices is in proper alignment with said media passage.

14. The improvement of claim 10 wherein said activating means comprises a pneumatic element which is attached to said media control sleeve, said media control sleeve, valve stem and pneumatic control element capable of being removed from said bore as a single assembly.

15. The improvement of claim 14 wherein said pneumatic element comprises a piston placed on said upper valve stem portion, said piston being placed in a sealed chamber, said chamber including means to apply air pressure on the underside of said piston to move said valve stem within said media control sleeve.

16. The improvement of claim 1 wherein said bore is inclined at an acute angle relative to said media passage.

17. The improvement of claim 1 wherein said media passage is a vertical passage.

18. In a media control valve for metering and dispensing particulate abrasive media from a supply pot to a compressed air stream which comprises a valve body having a media passage for receiving the abrasive media from the supply pot, a discharge passage communicating with said media passage and containing an outlet into an air flow tube below said discharge passage, said valve body including a bore separate from and disposed between said media passage and said discharge passage and communicating therewith, said bore containing a media control sleeve which contains a plurality of spaced restricting orifices, one of which can be aligned with said media passage so as to provide communication between said media passage, said bore and said discharge passage, a valve stem slidable within said media control sleeve, at least a portion of said valve stem capable of being disposed between said media passage and said discharge passage to prevent flow of media through said sleeve, activating means to move said valve stem within said media control sleeve, the improvement comprising: said valve further including index means capable of providing proper alignment of one of said spaced restricting orifices with said media passage upon rotation of said media control sleeve within said bore, said index means comprising a plurality of holes on said media control sleeve which are aligned with each of said spaced restricting orifices, and a peg means on the face of said valve body around said bore such that when one of said holes on said media control sleeve is placed within said peg, one of said spaced restricting orifices is in proper alignment with said discharge passage.

19. The improvement of claim 18 wherein the portion of said valve stem capable of being disposed between said media passage and said discharge passage contains a hard metallic sleeve.

20. The improvement of claim 19 wherein said metallic sleeve is separate from said valve stem and is bonded thereon.

21. The improvement of claim 20 wherein said metallic sleeve is tungsten carbide.

* * * * *